United States Patent [19]

Morris et al.

[11] Patent Number: 4,728,914

[45] Date of Patent: Mar. 1, 1988

[54] RATING PLUG ENCLOSURE FOR MOLDED CASE CIRCUIT BREAKERS

[75] Inventors: Robert A. Morris, Burlington; Paul T. Rajotte, Plainville; LeeAnne Wambolt, Colchester, all of Conn.

[73] Assignee: General Electric Company, New York, N.Y.

[21] Appl. No.: 45,645

[22] Filed: May 4, 1987

[51] Int. Cl.[4] ..... H01H 75/00

[52] U.S. Cl. ..... 335/6; 361/115; 361/357; 361/383; 361/395

[58] Field of Search ..... 248/27.1; 200/51 R, 200/289, 296; 165/80.2, 80.3, 80.4; 335/6, 18; 361/93, 115, 346, 356, 357, 379, 383, 395, 399, 412, 413, 415

[56] References Cited

U.S. PATENT DOCUMENTS

| | | | |
|---|---|---|---|
| 3,462,553 | 8/1969 | Sprayer | 361/383 |
| 3,857,044 | 12/1974 | Papoi | 361/383 |
| 4,037,184 | 7/1977 | Kempisty, Jr. | 335/6 |
| 4,064,469 | 12/1977 | Gryctko | 361/115 |
| 4,281,359 | 7/1981 | Bayer | 361/115 |
| 4,589,052 | 5/1986 | Dougherty | 361/94 |
| 4,649,455 | 3/1987 | Scott | 361/93 |

*Primary Examiner*—G. P. Tolin

*Attorney, Agent, or Firm*—Richard A. Menelly; Walter C. Bernkopf; Fred Jacob

[57] ABSTRACT

A molded plastic rating plug enclosure houses the molded case circuit breaker rating plug printed circuit board. The rating plug enclosure is inserted within the circuit breaker cover and is adapted for removal from the circuit breaker cover by means of a special extractor tool. Access means for connecting a test jack with the circuit breaker trip unit printed circuit board and visual access means for an indicating diode are formed within the cover of the rating plug enclosure.

16 Claims, 8 Drawing Figures

RATING PLUG ENCLOSURE FOR MOLDED CASE CIRCUIT BREAKERS

BACKGROUND OF THE INVENTION

U.S. Pat. No. 4,589,052 describes an electronic trip unit for molded case circuit breakers wherein the trip function is provided by means of an integrated circuit chip. U.S. Pat. No. 4,649,455 describes a rating plug circuit wherein the rating of the breaker can be adjusted over a wide operating range by selection of an appropriate burden resistor.

U.S. patent application Ser. No. 862,929 filed May 14, 1986 entitled "Trip Actuator for Molded Case Circuit Breakers" describes an electromagnetic actuator that interfaces between the trip unit electronics and the circuit breaker operating mechanism to separate the circuit breaker contacts in response to overcurrent conditions.

U.S. patent application Ser. No. 882,989 filed July 7, 1986 entitled "Combined Trip Unit and Accessory Module for Electronic Trip Circuit Breakers" describes an accessory module which is accessible from the circuit breaker cover and which allows convenient access to the electromagnetic actuator for selection of various accessory options.

All the aforementioned U.S. Patents and Patent Applications are incorporated herein for purposes of reference and should be reviewed for the specific teachings contained therein.

As described within the aforementioned U.S. Pat. No. 4,649,455, it is possible to select the resistance value of the burden resistor within the circuit breaker electronics for setting the circuit breaker rating. The use of such an adjustable rating plug, is governed by strict electrical industry standards, since it is important that the proper rating plug be inserted within the appropriate circuit breaker in order for the circuit breaker to operate properly. One such requirement mandates that the circuit breaker will either trip or default to its lowest rating when the rating plug is removed from the circuit breaker enclosure. A further requirement is that some tool must be required for removing the rating plug from the circuit breaker to deter inadvertent or negligent removal thereof.

One purpose of this invention is to describe a rating plug enclosure which subscribes to the electrical industry standards while providing ready access to the rating plug burden resistors mounted on the rating plug printed circuit board.

SUMMARY OF THE INVENTION

A self-contained electronic circuit breaker contains optional accessory features and a rating plug accessible through the circuit breaker cover. Both the accessory and the rating plug are removable from the circuit breaker cover without environmentally affecting the remaining circuit breaker components. The rating plug enclosure is adapted for removal from the circuit breaker by means of a special extractor tool.

DESCRIPTION OF THE PREFERRED EMBODIMENT

Figure 1:
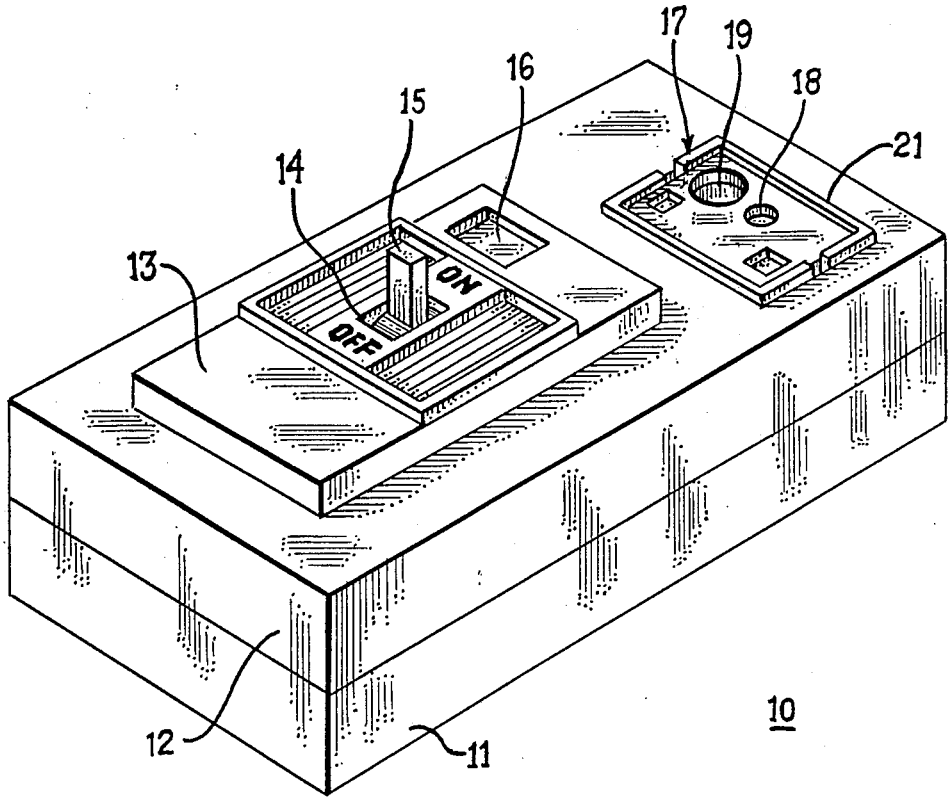
FIG. 1 is a top perspective view of a self-contained electronic circuit breaker having both accessory and rating selectability.

A self-contained electronic circuit breaker 10 is depicted in FIG. 1, wherein along with overcurrent protection facility, a plurality of accessory options are included within a common housing. The circuit breaker housing consists of a case 11 and a cover 12 upon which an elevated escutcheon 13 is integrally formed. An operating handle 15 extends through an opening 14 for setting the circuit breaker in its "on" and "off" conditions. The accessory options are reached by means of an accessory door 16 which is located on the escutcheon 13. Also arranged on the cover, is a rating plug 17, which includes a test jack access hole 19 within the rating plug cover 21, along with an indicating lamp visual access hole 18. The selection of the various accessory options by means of the accessory access door 16 is described within the aforementioned U.S. patent application Ser. No. 882,989.

Figure 2:
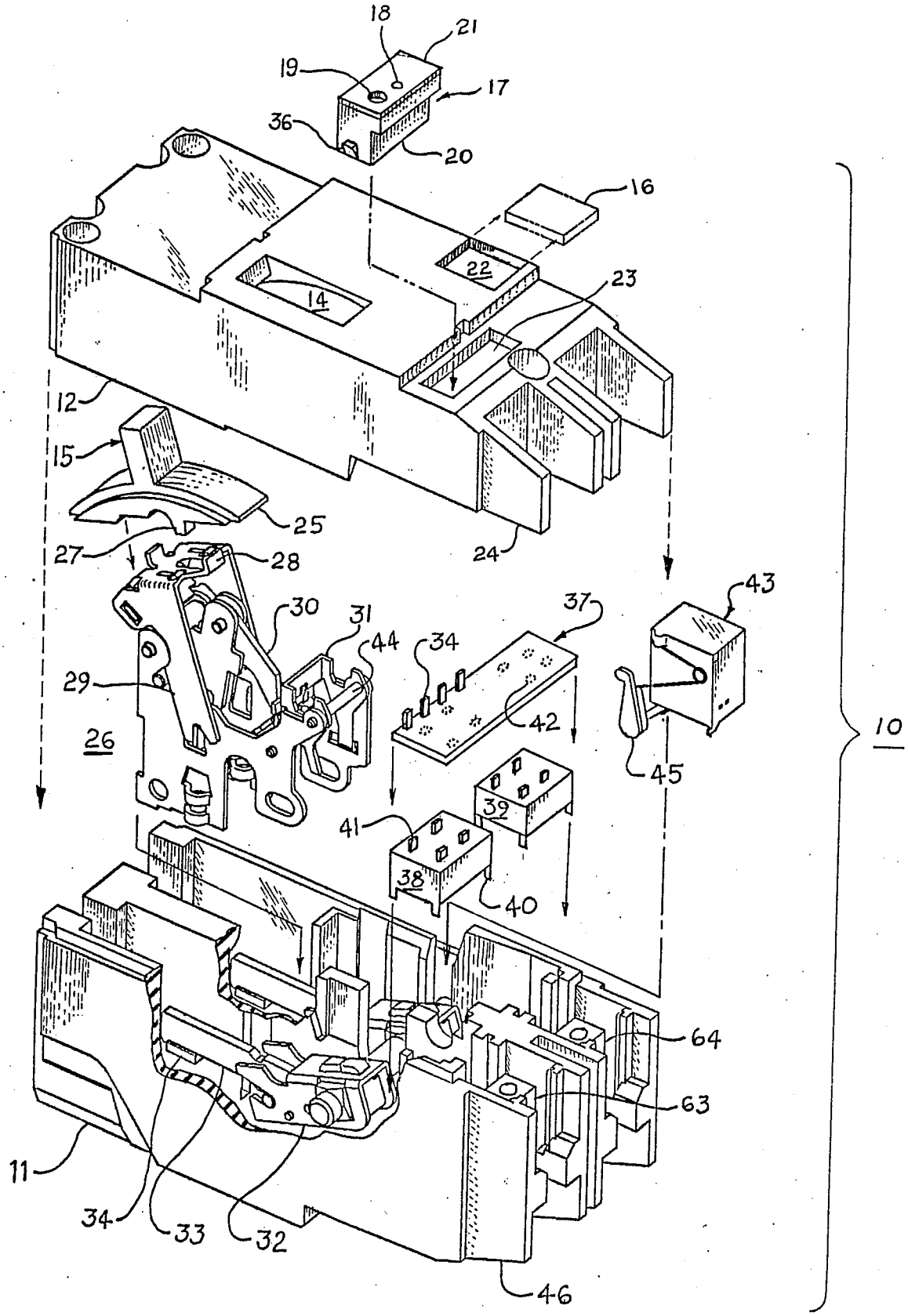
FIG. 2 is a top perspective view in isometric projection of the components used within the circuit breaker of FIG. 1.

The assembly of the self-contained electronic circuit breaker 10 is seen by referring to FIG. 2 wherein the internal components include an operating mechanism 26 with which the operating handle 15 interacts by means of the handle flange 25. A downward projection 27 on the handle flange cooperates with a tab 28 extending upwards from the mechanism side frame 29 to move the cradle operator 30 in and out of engagement with the cradle latch 31. The operating mechanism in turn interacts with a movable contact carrier 33, which supports a movable contact 34 at one end, by moving the cross bar 32 between its open and closed positions. The arrangement of a trip actuator 43 for interacting with the trip bar 44 by means of an operating arm 45 upon receipt of a trip signal received from a trip unit contained within the trip unit printed circuit board 37 is described within aforementioned U.S. patent application Ser. No. 882,989. After the operating mechanism 26 and trip actuator 43 are positioned within the circuit breaker case 11, the current sensing transformers 38, 39 are positioned within the circuit breaker case by inserting downwardly depending tabs 40 within corresponding slots (not shown) formed in the bottom of the circuit breaker case. The transformers are positioned in-board a pair of load terminal lugs 63, 64 which are located within a pair of baffles 46 integrally formed and extending from the circuit breaker case. The trip unit printed circuit board 37 is electrically connected with the transformers by capturing a plurality of pins 41 extending from the top surface of the transformers within a corresponding plurality of sockets 42 formed in the bottom of the trip unit printed circuit board. The rating plug 17, shown generally to consist of a molded plastic case 20 and a molded plastic cover 21, is inserted within an access opening 23 formed within the circuit breaker cover 12 in-board the load terminal baffles 24 which are integrally formed with and extend from the circuit breaker cover. The rating plug is electrically connected with the trip unit printed circuit board 37 by inserting a plurality of stabs 36 accessed through the bottom of the rating plug case within a corresponding plurality of contacts 34 extending from a top surface of the trip unit printed circuit board. When the rating plug is inserted within the access opening 23, the cover 21 lies coextensive with the top surface of the circuit breaker cover such that both the test jack access hole 19 and the indicating lamp visual access hole 18 are also coextensive with the top surface. A circuit breaker accessory unit (not shown) is inserted within the access opening 22 and the accessory door 16 is then placed over the opening.

Figure 3:
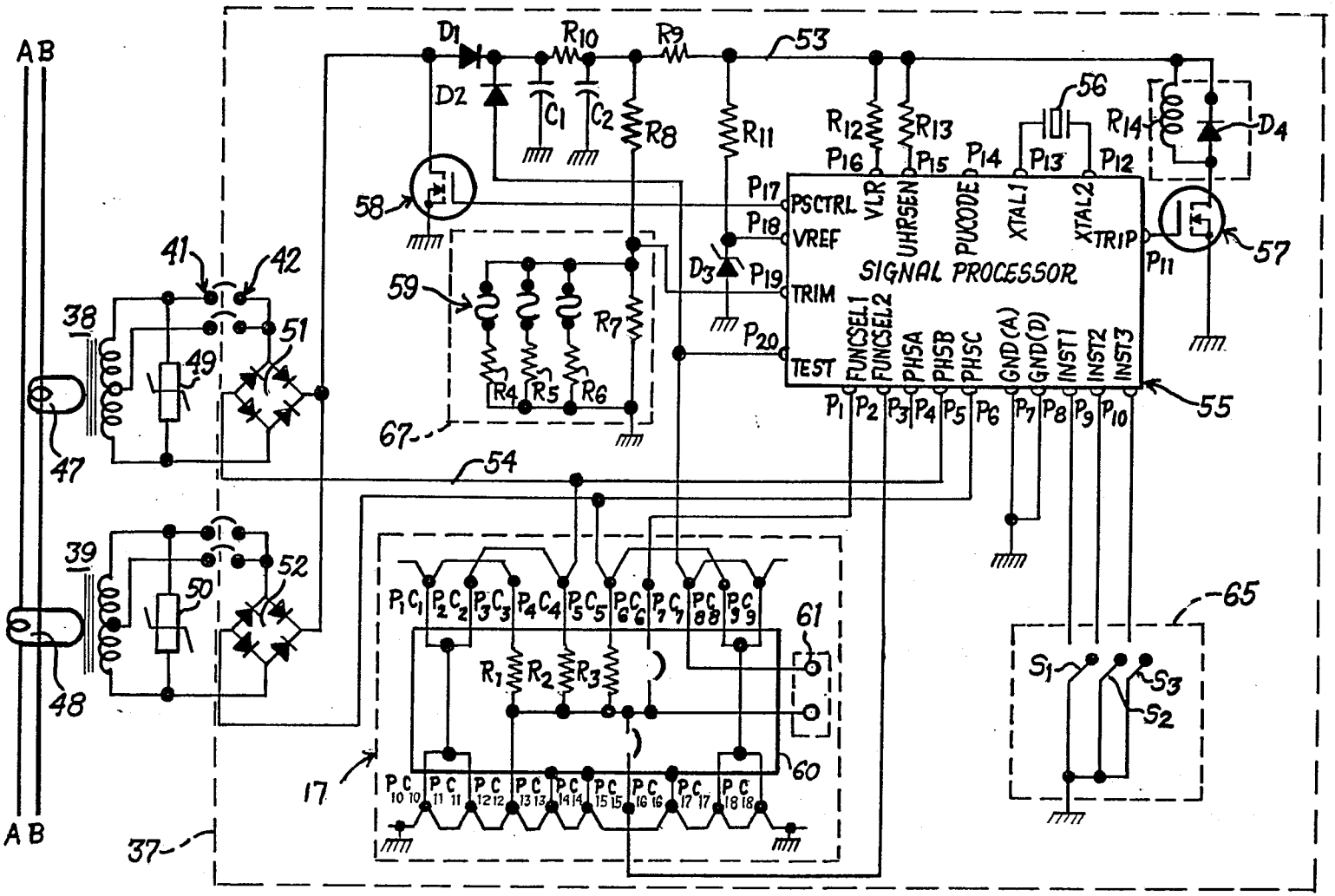
FIG. 3 is a schematic representation of the electronic components contained within the circuit breaker depicted in FIG. 1.

The electrical connection between the current transformers 38, 39 and the trip unit printed circuit board 37 is seen by referring to FIGS. 2 and 3 wherein the pins 41 extending from the top of the current transformers are connected with the sockets 42 on the trip unit printed circuit board. A pair of Zener diodes 49, 50 are arranged across the secondary windings of the current transformers to protect the transformers from overvoltage transients occurring when the transformers are electrically connected with the conductors of a power bus generally indicated at A, B. The operation of the trip unit printed circuit board 37 is described within aforementioned U.S. Pat. No. 4,589,052 to consist of a signal processor in the form of an integrated circuit chip 55 which electrically connects with the current transformers through a pair of bridge rectifiers 51, 52 and conductors 53 and 54. The trip circuit includes diodes D1–D4, capacitors C1–C2 and resistors R4–R14 which interconnect with the signal processor integrated circuit 55 by means of pin connections $P_1$–$P_{20}$. A quartz crystal 56 provides a clock signal to the signal processor integrated circuit and a pair of Field Effect Transistors 57, 58 are connected with the signal processor integrated circuit to provide trip signals to interrupt the circuit. A multi-position switch 65 connects with the signal processor integrated circuit to set the instantaneous trip levels of the breaker by means of switches S1–S3 as described in the aforementioned U.S. Pat. No. 4,649,455, while the option-select circuit 67 including resistors R4–R7 and fusable links 59, allow selection of the specific functions of the circuit breaker by melting selected ones of the fusable links. The option-selector circuit 67 is also described in the latter referenced U.S. Pat. No. 4,589,052. The rating plug circuit board 60 contained within the rating plug described generally at 17 in FIG. 2, electrically connects with the trip unit printed circuit board 37 by means of the stabs 36 on the bottom of the rating plug of FIG. 2 which comprise pins $p_1$–$p_{18}$ on the schematic depicted in FIG. 3 while the stab connectors 34 on the trip unit printed circuit board 37 of FIG. 2 comprise connectors $c_1$–$c_{18}$. The test jack terminals 61 are accessed through the test jack access hole 19 of FIG. 2. Electrical connection with an external test jack is made by means of metal rings 83 arranged on an internal surface of the test jack 82 as best seen in FIG. 6.

Figure 4:
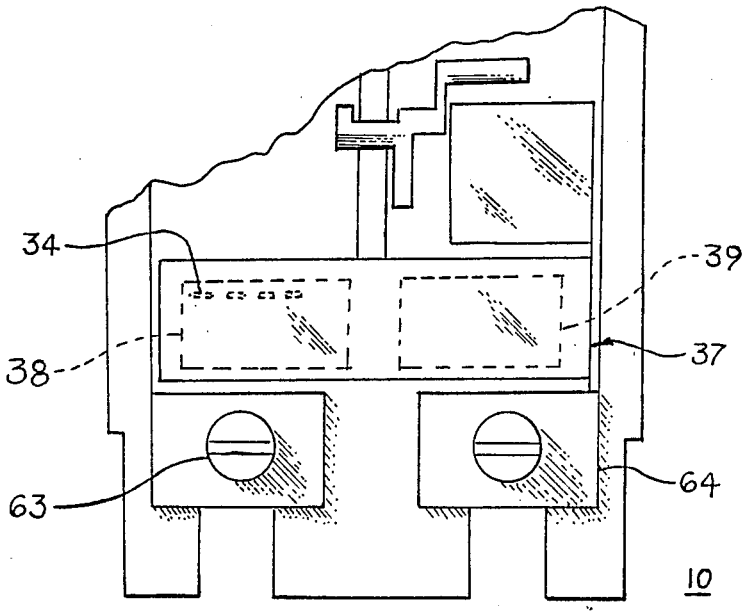
FIG. 4 is a plan view of the circuit breaker depicted in FIG. 1, with its cover removed.

The self-contained electronic breaker 10 of FIG. 1 is depicted in FIG. 4 with its cover removed to show the arrangement of the trip unit printed circuit board 37 over the current transformers 38, 39 and with the stab connectors 34 extending upwards for receiving the rating plug stabs 36 (not shown).

Figure 5:
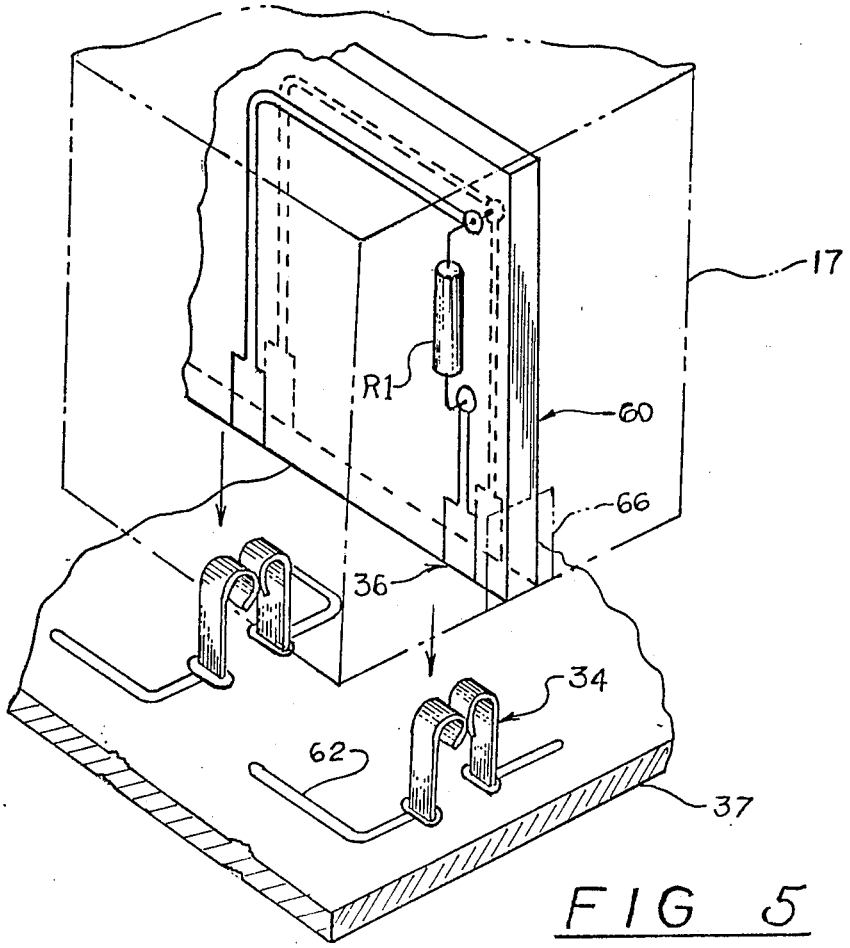
FIG. 5 is a top perspective view in isometric projection detailing the rating plug enclosure depicted in FIG. 2 prior to connection with the trip unit printed circuit board also depicted in FIG. 2.

The electrical connection between the rating plug printed circuit board 60 and trip unit printed circuit board 37 is best seen by referring now to FIG. 5. The stabs 36 on the rating plug printed circuit board 60 are arranged next to a plurality of access slots 66 formed in the bottom of the rating plug which is indicated in phantom for purposes of illustration. The stab connectors 34 extending from the trip unit printed circuit board electrically connect with the trip unit printed circuit boards by a plurality of thick film conductors 62 when the stabs 36 are inserted within the stab connectors 34. The arrangement between the stabs and stab connectors is described within the aforementioned U.S. Pat. No. 4,649,455.

Figure 6:
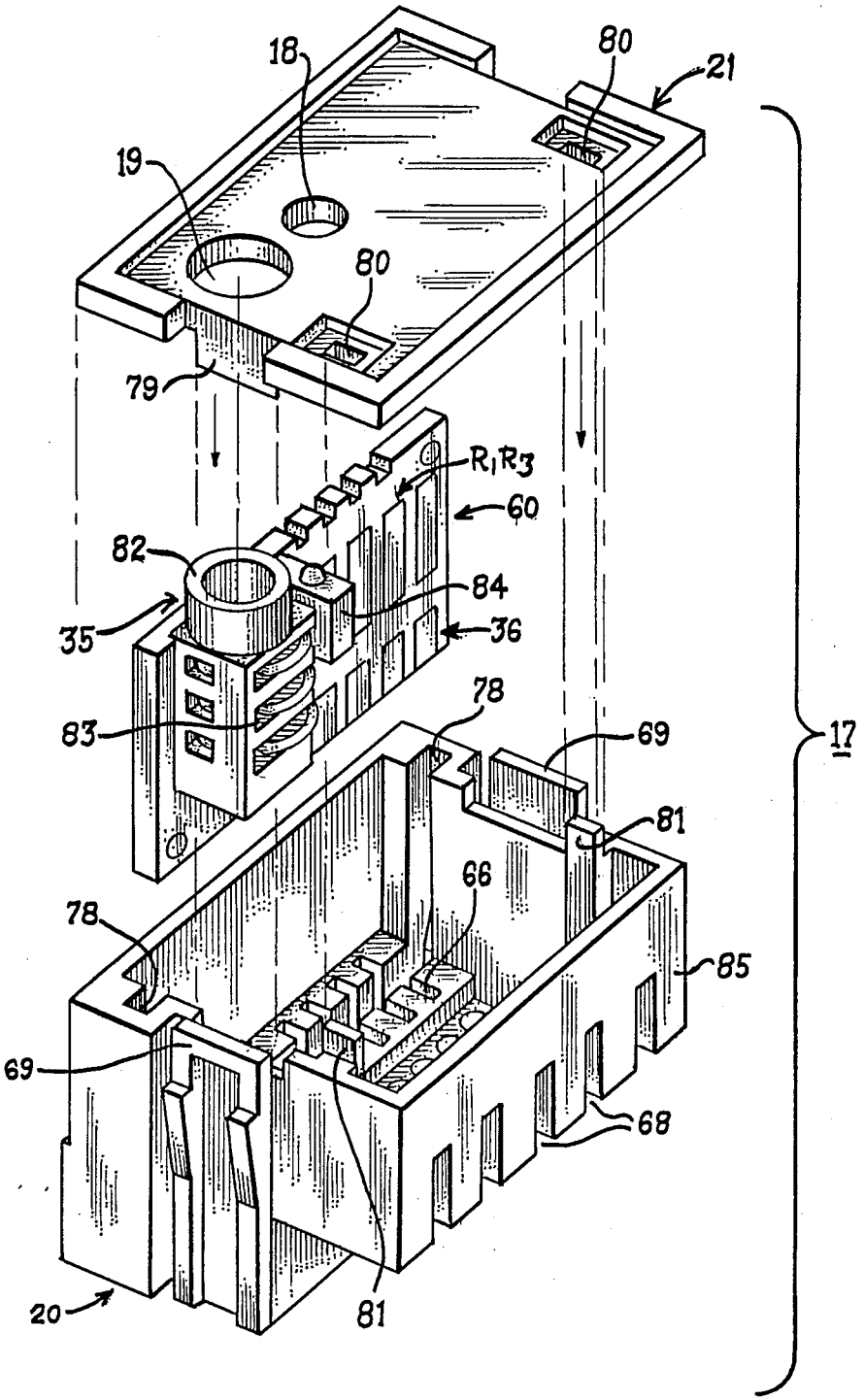
FIG. 6 is a top perspective view in isometric projection of the components used to form the rating plug depicted in FIG. 2.
Figure 7A:
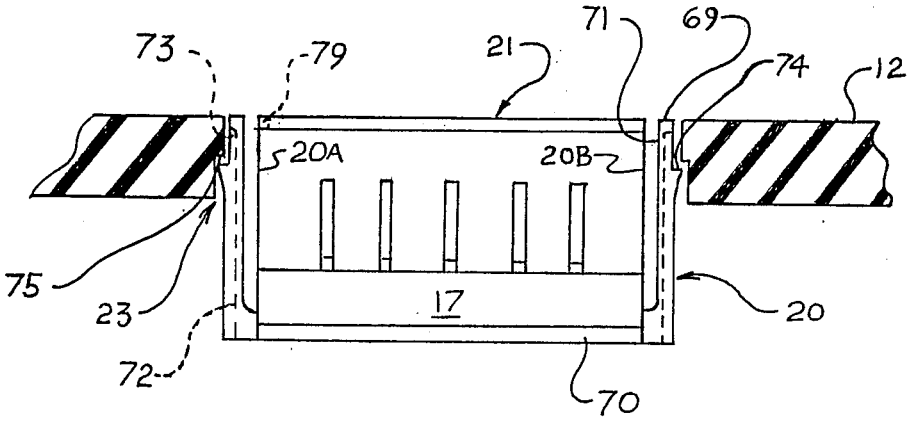
FIGS. 7A and 7B are side views, in partial section, of the rating plug of FIG. 2 prior to removal from the circuit breaker cover.
Figure 7B:
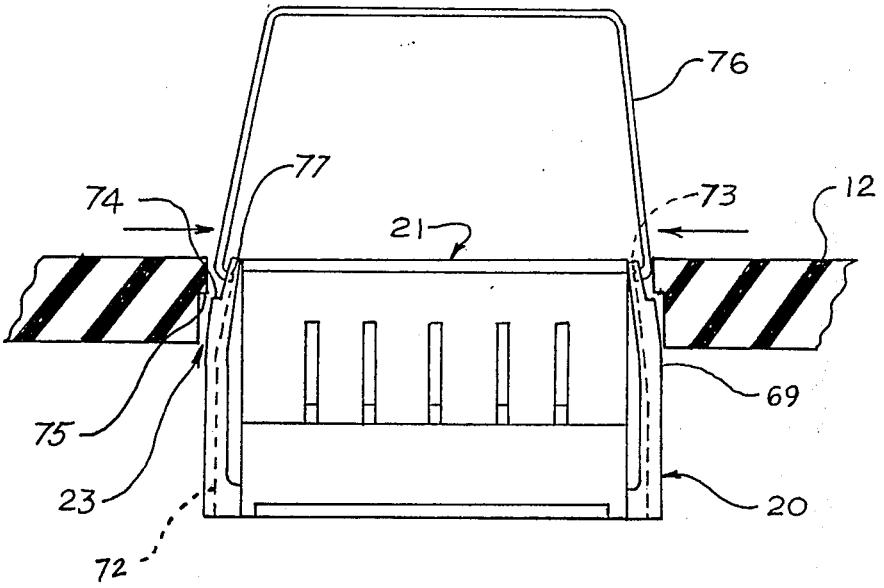

The connection between the rating plug printed circuit board 60, the rating plug case 20, and rating plug cover 21 can be seen by now referring to FIG. 6. The access slots 66 are formed through the bottom of the rating plug case and the printed circuit board is arranged within a pair of opposing slots 78 integrally formed on the interior of the case. A plurality of cooling air access slots 68 are formed within the front case extension 85 to provide for ventilating the interior of the rating plug enclosure to prevent any overheating of the electronic components contained therein. A pair of side case projections 69 are integrally formed with the rating plug case to assist in attaching the rating plug 17 to the circuit breaker cover as will be discussed below. A pair of attachment tabs 81 extend up from the rating plug case 20 to engage a corresponding pair of attachment slots 80 formed within the rating plug cover 21 and are ultrasonically flattened to seal the cover to the case. A pair of clearance slots 79 are formed on the sides of the rating plug cover to allow for passage of the side projections 69 in the manner to be described by referring now to FIGS. 7A and 7B. The circuit breaker cover 12 is provided with a pair of undercut edges 75 formed within the access hole 23 for receiving a pair of detent lips 74 formed on the outside of the side projections 69. The opposite side of the side projections 69 has an elongated groove 72 formed therein that terminates at a top edge 73 for purposes which will now be described with reference to FIG. 7B. When the rating plug 17 is inserted within the access hole 23, the side projections 69 flex towards the rating plug case 20 to allow the detent lips 74 to clear the undercut edges 75 before returning to the position shown in 7A with the detent lips 74 trapped beneath the undercut edges 75. The side projections 69 are formed on the rating plug case with an elongated clearance slot 71 intermediate the side walls 20A, 20B to allow the side projections 69 sufficient clearance for the rating plug to be removed from the circuit breaker cover. In FIG. 7B an extractor tool 76, such as that used within the semiconductor industry, is inserted between the outside surfaces of the side projection 69 and the circuit breaker cover 12 such that the extractor tool hooked ends 77 catch under the top edges 73 of the elongated groove 72. Compressing the extractor tool in the direction indicated, moves the side projections within the elongated clearance slots 71 as well as within the clearance slot 79 formed in the rating plug cover 21. The flexing of the side projections 69 away from the undercut edges 75 frees the detent lips 74 from under the undercut edges and allows the rating plug to be completely withdrawn from the access opening 23.

It has thus been shown that a self-contained electronic circuit breaker having accessory options and variable ratings can be provided in a single unitary enclosure. The rating plug electrically interconnects with the circuit breaker trip unit to set the circuit breaker rating and cannot be removed without the use of a special tool.

Having thus described our invention, what we claim as new and desire to secure by Letters Patent is:

1. A circuit interrupter comprising:

an operating mechanism connected with a pair of separable contacts arranged for separating the contacts upon occurrence of an overload condition through the contacts;

an electromagnetic actuator connected with an electronic trip circuit and arranged proximate the operating mechanism said actuator including means for articulating the operating mechanism upon receipt of an actuating signal from said electronic trip circuit;

an insulative circuit interrupter case and a removable cover surrounding said operating mechanism and said actuator, said interrupter cover including recess means formed therein;

a rating plug enclosure including a case and a removable cover housing a rating plug circuit, said circuit including at least one rating resistor, said rating plug case including electrical access means through which electrical interconnection of said rating resistor with said electronic trip circuit, said rating plug enclosure being inserted within said recess means; and a pair of detent means formed on opposing outer surfaces of said opposing sides of said rating plug case, said detent means being captured under ledges formed within said recess, said rating plug cover includes a pair of slots aligned with and arranged over said detent means, said slots providing insertion access for a removal tool.

2. The circuit interrupter of claim 1 wherein said trip circuit includes a test circuit and wherein said rating plug circuit includes test jack socket means providing external electrical connection with said test circuit.

3. The circuit interrupter of claim 1 wherein said rating plug case includes a side extension having a plurality of elongated ventilation slots formed therethrough.

4. The circuit interrupter of claim 1 wherein said electrical access means on said rating plug case comprises a plurality of electrical access slots formed through a bottom of said rating plug case.

5. The circuit interrupter of claim 1 wherein said rating plug circuit is arranged on a printed circuit board.

6. The circuit interrupter of claim 5 wherein said rating plug case includes a pair of slots formed on opposing inner surfaces of opposite sides of said rating plug case and wherein said printed circuit board is retained within said pair of slots.

7. The circuit interrupter of claim 1 wherein said detent means each comprise a strip of plastic extending along said opposite sides of said rating plug case.

8. The circuit interrupter of claim 7 including a slot intermediate said plastic strip and said opposite sides of said rating plug case, said plastic strip being arranged over said slot in cantilevered relation.

9. The circuit interrupter of claim 5 wherein said rating plug printed circuit board includes a plurality of contact pads on one edge and a plastic cylinder extending from an opposite edge, said plastic cylinder including a plurality of metal rings on an inner surface thereof for electric connection with a test jack.

10. The circuit interrupter of claim 9 wherein said rating plug cover includes an access opening over said plastic cylinder for receiving said test jack.

11. The circuit interrupter of claim 1 including at least one integrally formed plastic pin extending from said rating plug case through a corresponding opening through said rating plug cover, said pin being flattened to hold said rating plug cover to said rating plug case.

12. A rating plug for circuit interrupters comprising:

a molded plastic case and removable cover;

a rating plug circuit with means for adjusting the rating of a molded case circuit interrupter, said circuit being mounted on a printed circuit board within said case and cover;

an extension on one side of said cover incuding a plurality of elongated ventilation slots;

a pair of retainer slots integrally formed on interior surfaces of opposing sides of said case slidingly receiving said printed circuit board;

a pair of detents integrally formed on exterior surfaces of said opposing sides of said case outboard said interior slots and cooperating with a circuit interrupter cover and holding said rating plug case within said circuit interrupter cover, said removable cover including a pair of slots through outer edges of said removable cover aligned with an over said detents and providing access to a bifurcated tool for removing said rating plug case from said circuit interrupter cover.

13. The rating plug of claim 12 wherein said printed circuit board includes a plurality of contact pads within a plurality of electrical access slots formed in a bottom of said case.

14. The rating plug of claim 13 wherein said detents are cantilevered from said case bottom.

15. The rating plug of claim 12 wherein said printed circuit board further includes a plastic cylinder extending therefrom and including a plurality of metal rings within said cylinder electrically connecting with said printed circuit board whereby a test jack becomes electrically connected with said printed circuit board via said rings and is inserted within said plastic cylinder.

16. The rating plug of claim 12 wherein said removable cover further includes an access opening over said cylinder receiving a test jack.

* * * * *